US006973897B2

(12) United States Patent
Haubner

(10) Patent No.: US 6,973,897 B2
(45) Date of Patent: Dec. 13, 2005

(54) COOLED CYLINDER HEAD FOR A RECIPROCATING ENGINE

(75) Inventor: Frank Haubner, Aachen (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 11/016,748

(22) Filed: Dec. 21, 2004

(65) Prior Publication Data

US 2005/0145205 A1 Jul. 7, 2005

Related U.S. Application Data

(63) Continuation of application No. PCT/EP2003/006440, filed on Jun. 18, 2003.

(30) Foreign Application Priority Data

Jun. 21, 2002 (DE) ..... 102 27 690

(51) Int. Cl.[7] ..... F02F 1/36
(52) U.S. Cl. ..... 123/41.82 R
(58) Field of Search ..... 123/41.82 R

(56) References Cited

U.S. PATENT DOCUMENTS 3,769,948 A * 11/1973 Feichtinger et al. .. 123/41.82 R
6,363,893 B1 4/2002 Xin et al.

FOREIGN PATENT DOCUMENTS

| | | |
|---|---|---|
| EP | 1 028 246 A2 | 8/2000 |
| FR | 1 423 241 A | 1/1966 |
| FR | 2 682 994 A | 4/1993 |

* cited by examiner

*Primary Examiner*—Noah P. Kamen
(74) *Attorney, Agent, or Firm*—Venable LLP; Robert Kinberg

(57) ABSTRACT

The invention relates to a cylinder head comprising a water jacket that is delimited by a flame deck and an oil deck in a water-cooled reciprocating engine with cylinders that are arranged in series, each of said cylinders having at least one intake valve comprising intake ducts and two exhaust valves, whose exhausts open into exhaust ducts, in addition to a receptacle for a fuel injector or a spark plug that is located between the intake valve and the exhaust valves. The cylinder head is characterised in that a system of channels is provided at least in the vicinity of the exhaust side of each cylinder in order to conduct the coolant in the water jacket, whereby the coolant supply is conducted through said system from the exterior on one side of the exhaust duct towards the receptacle and is returned from the interior to the exterior on the other side of the exhaust duct and in that an overflow channel is provided.

15 Claims, 12 Drawing Sheets

COOLED CYLINDER HEAD FOR A RECIPROCATING ENGINE

CROSS-REFERENCE TO RELATED APPLICATION

This is a continuation of International Patent Application No. PCT/EP2003/006440 filed Jun. 18, 2003, designating the United States and claiming priority of German Patent Application No. 102 27 690.0 filed Jun. 21, 2002, the disclosures of both foregoing applications being incorporated herein by reference.

BACKGROUND OF THE INVENTION

The invention relates to high performance reciprocating engines, particularly to direct injection high performance spark ignition engines or high performance compression ignition engines, in which the exhaust area in the cylinder head is highly thermally stressed.

SUMMARY OF THE INVENTION

It is an object of the invention to provide a cylinder head, which effects an improved cooling particularly in the region of the exhausts.

For a cylinder head comprising a water jacket limited by a flame deck and an oil deck at a water cooled reciprocating engine with cylinders that are arranged in series, each of said cylinders comprises at least one intake valve with an intake connection and two exhaust valves, which exhausts open into an exhaust duct with a receptacle for a fuel injector or a spark plug, that is located between the intake valve and the exhaust valves, this objective is solved according to the invention in that for conducting a coolant in the water jacket a channel arrangement is provided at least in the region of an exhaust side of each cylinder, through which in an inflow the coolant supply is conducted from the exterior on one side of the exhaust duct inwards towards the receptacle and is conducted in a reflux from the interior to the exterior on the other side of the exhaust duct and in that an overflow channel is provided, conducting a return flow path, as viewed with respect to the direction of flow, to a supply flow path of the channel arrangement of a consecutive cylinder head region. Thereby, a U-shaped surrounding flow of the exhaust ducts is effected for each of them, since the cooling water is initially conducted from the exterior on one side of the exhaust duct towards the receptacle and is afterwards conducted on the other side of the exhaust ducts to the exterior. Thus, it is possible to cool the region between the two exhaust valves reliably. The cooling water flows in vertical direction in the region of the receptacle, so that also this region is cooled intensively. Therewith, in the region of each exhaust the flow is across the main axis of the engine according to a cross-flow concept. Particularly appropriate, the cooling water flows below the exhaust duct to the interior and above the exhaust duct the cooling water flows to the exterior.

In a preferred embodiment a separation is provided in the water jacket in order to conduct the cooling water between adjacent cylinders.

According to another preferred embodiment the water jacket that is limited by the flame deck and the oil deck is separated by an intermediate deck into an upper part of the water jacket and a lower part of the water jacket. On the one hand hereby results a simplification with respect to casing practice of the cylinder head. On the other hand it is possible to provide comparatively thin wall thicknesses for the intake duct or intake ducts, respectively, as well as for the exhaust ducts, whereupon overall the member "cylinder head" gains a higher structural stability and a superior stiffness, and in total the casting may be manufactured with thinner walls.

In an embodiment of the invention is hereby provided that one of the said parts of the water jacket, preferably the lower part, is connected on a supply side to the overflow channel and that the other part of the water jacket is connected on a drain side to the part of the water jacket of the region of the adjacent cylinder, preferably to the lower part, via the overflow channel, respectively.

According to the invention the conduction of flow through a lower and an upper part of the water jacket results from that the intermediate deck comprises at least one flow passage opening connecting the lower part of the water jacket with the upper part of the water jacket.

In a preferred embodiment of the invention a flow passage opening may be located in the region of the intake connections, respectively. Particularly in a reciprocating engine with two inlet valves it is convenient, to arrange a flow passage opening between two intake ducts in an intermediate deck.

In another preferred embodiment is provided that at each of separations facing each other and limiting the parts of the water jacket, at least one flow passage opening connecting the lower part of the water jacket with the upper part of the water jacket is arranged. In particular, it is hereby convenient to arrange each of the flow passages openings at opposing separations in a region of a longitudinal center axis. In this arrangement of water conduction the region of the intake ducts is not directly circulated around with cooling water. However, due to formation of swirls and sweeping forces dead water zones will not emerge, so that the required cooling for the intake ducts is effected. However, the particular advantage of this arrangement is, that cores keeping open the flow passage openings may simultaneously serve as support of cores for the upper part of the water jacket during the manufacture.

In a further preferred embodiment of the invention is provided that a supply-sided part of the channel arrangement comprises a main channel running between exhaust ducts of the exhaust valves and a branch channel, which is lead around each exhaust duct and which runs into the reversion region confined by the receptacle. Due to a suitable rating of the main and the branch channel it is effected, that the main portion of the flow runs between the two exhausts, hereby achieving a sufficient carrying off of heat in this critical area.

Preferably the separation further comprises at least one overflow channel connecting a channel arrangement of adjacent cylinders.

In an embodiment of the invention it is further provided, that the intake duct is enfolded by a flow channel at least at the side that opposes the exhaust ducts. Also in this case it is convenient to interconnect the flow channels of adjacent cylinders enfolding the intake ducts via a flow passage opening in the separation, respectively.

Due to a suitable dimensioning of the flow passage openings in the separation of the interconnection of the drain-sided channel arrangement as well as of the supply-sided flow channels the increased flow according to the higher thermal stress in the exhaust region may be conducted through the drain-sided channel arrangement as well.

BRIEF DESCRIPTION OF THE DRAWINGS

Further elements and embodiments of the invention will be seen from the following description and the related drawings. In the drawings.

DETAILED DESCRIPTION OF THE INVENTION

Figure 2:
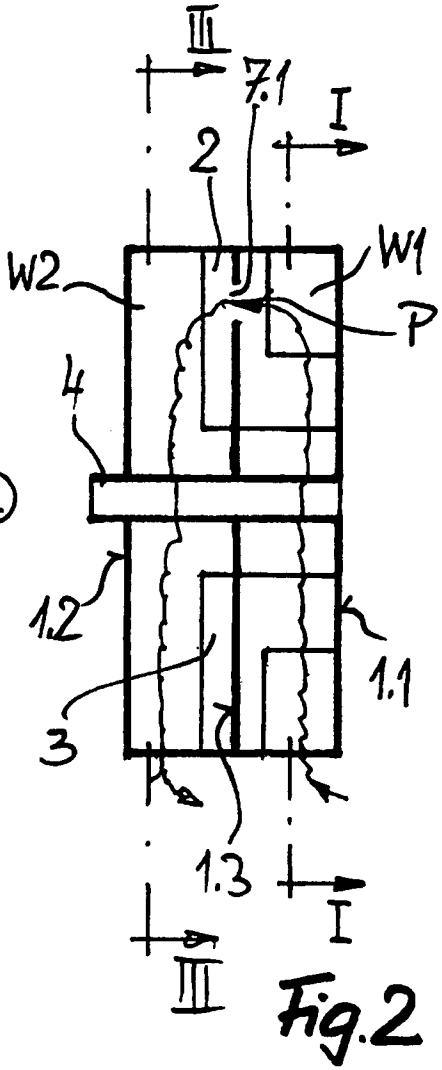
FIG. 2 shows a vertical section of the cylinder head according to the line II—II in FIG. 1.
Figure 1:
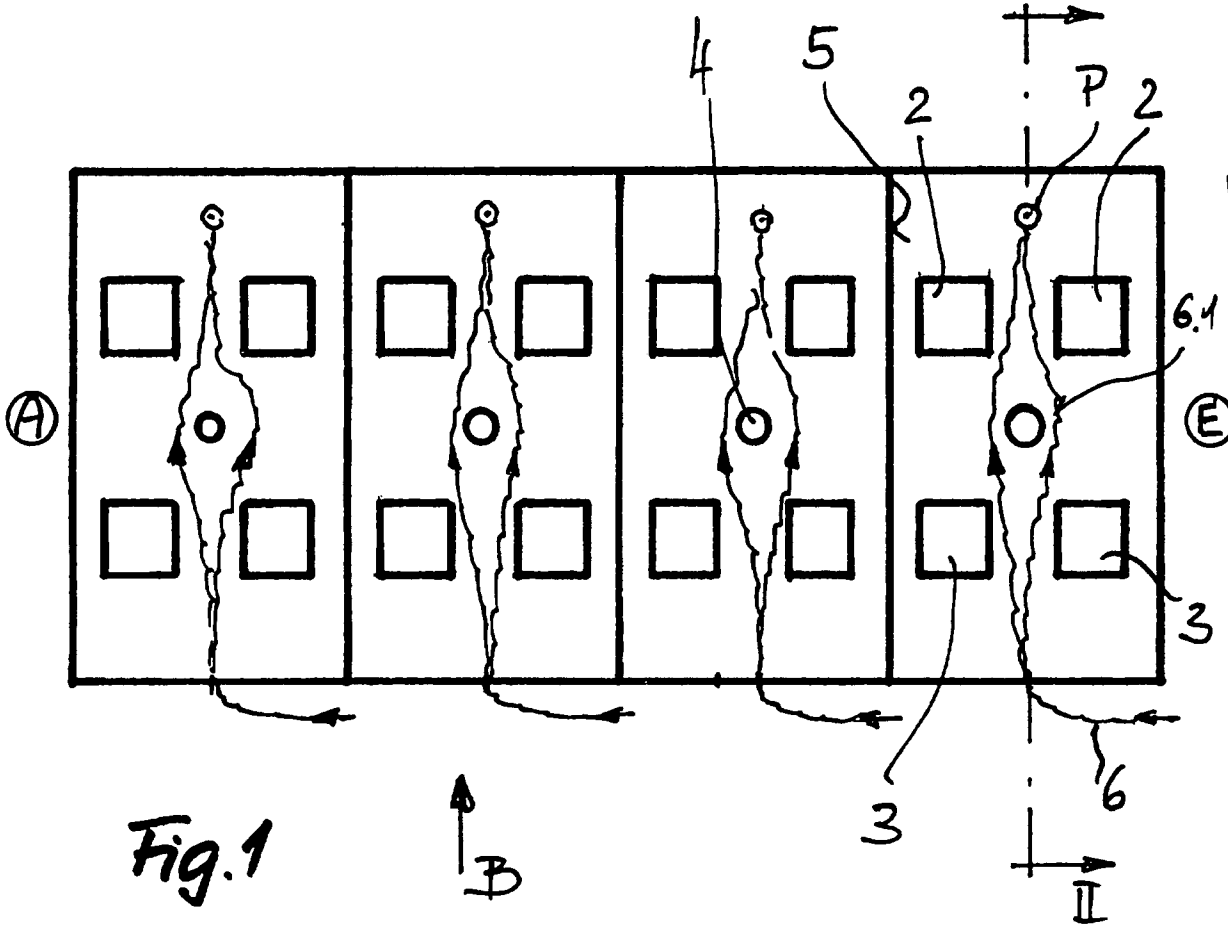
FIG. 1 shows a sectional view of a cylinder head, which is separated by an intermediate deck into an upper and a lower part of a water jacket according to line I—I in FIG. 2.
Figure 3:
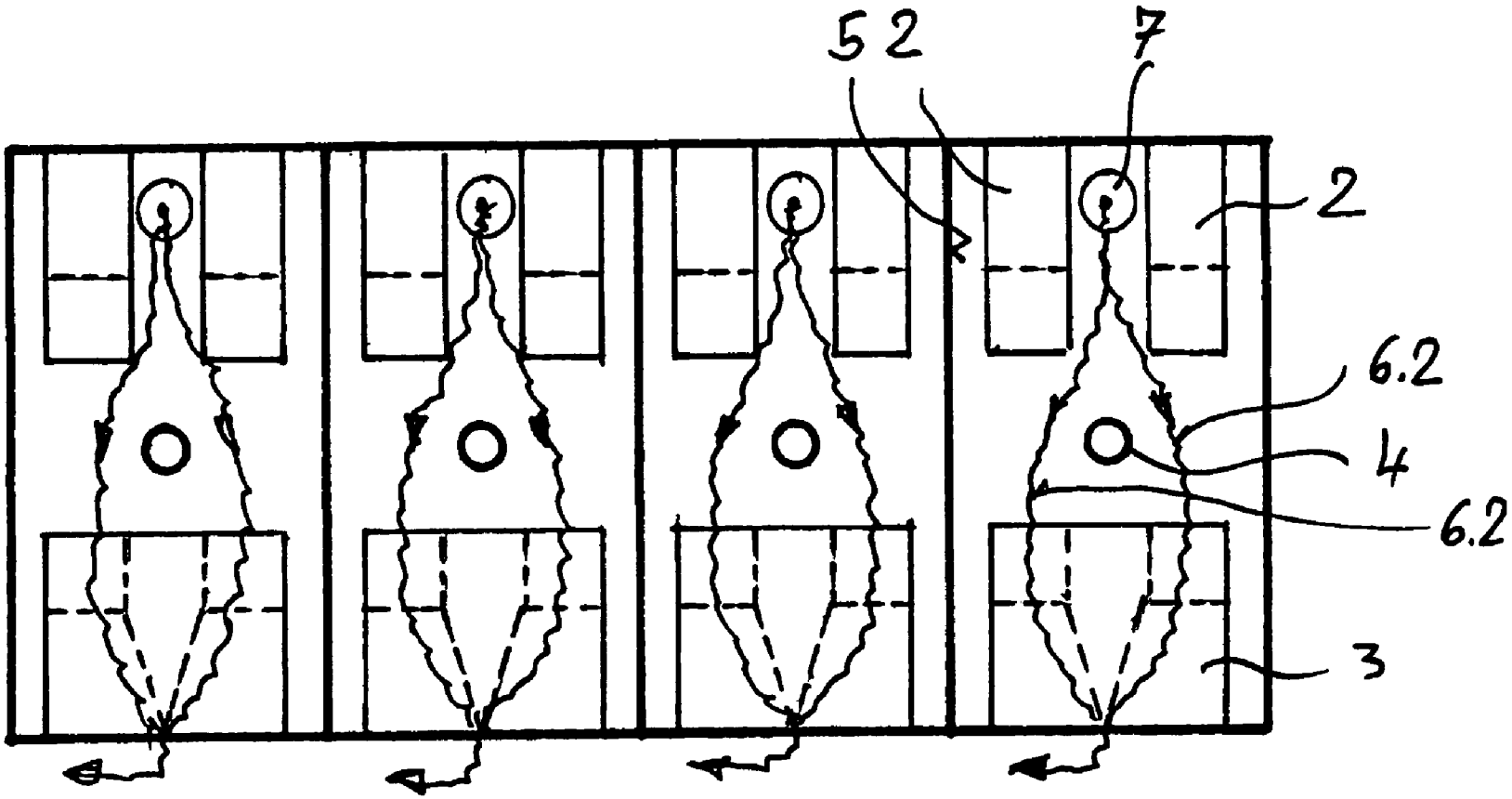
FIG. 3 shows a horizontal section of the cylinder head according to the line III—III in FIG. 2.

In FIGS. 1, 2 and 3 a cylinder head of a four-cylinder reciprocating engine with its flame deck 1.1, an oil deck 1.2 and an intermediate deck 1.3 are schematically shown in the denoted sections. For simplification the lines of the edges of the section are drawn in full line style whereas the lines for the edges of the aspect are drawn with thinner thickness. Each cylinder is provided with two intake valves characterized by their intake ducts 2. Furthermore, each cylinder is provided with two exhaust valves indicated by their common exhaust duct 3. In between each of the intake connections and the exhaust connections a receptacle is arranged for a fuel injector or a spark plug.

Between two adjacent cylinders in each case a transversely arranged separation is arranged sealing the intake and exhaust regions of each cylinder from each other.

In each region of the cylinder of the cylinder head, that is in between two separations 5 respectively, the water jacket limited by the flame deck 1.1 and the oil deck 1.2 is separated by the intermediate deck 1.3 into a lower part of the water jacket W1 and an upper part of the water jacket W2, which forms the channel arrangement for conduction of the coolant. For a flow of cooling water from the lower part of the water jacket W1 into the upper part of the water jacket W2 flow passage openings are provided.

The cooling water is conducted from a supply side E to a drain side A of the cylinder head. The conduction of the cooling water through the channel arrangement inside the water jacket is displayed in flow path 6. The flow of the cooling water flows via the flow path 6.1 from the exterior below the exhaust duct 3 into the lower part of the water jacket W1 separated by the two separations 5 and the intermediate deck 1.3. Further, it flows below the exhaust duct 3 between the two separated exhausts of the exhaust valves towards the receptacle 4, circulates around said receptacle and finally flows to the intake ducts 2. A reversion region is formed by a flow passage opening 7.1 in the intermediate deck 1.3 effecting a re-direction into the upper part of the water jacket W2. The view from above the drawing shows the head of the arrow P in FIG. 2.

Figure 4:
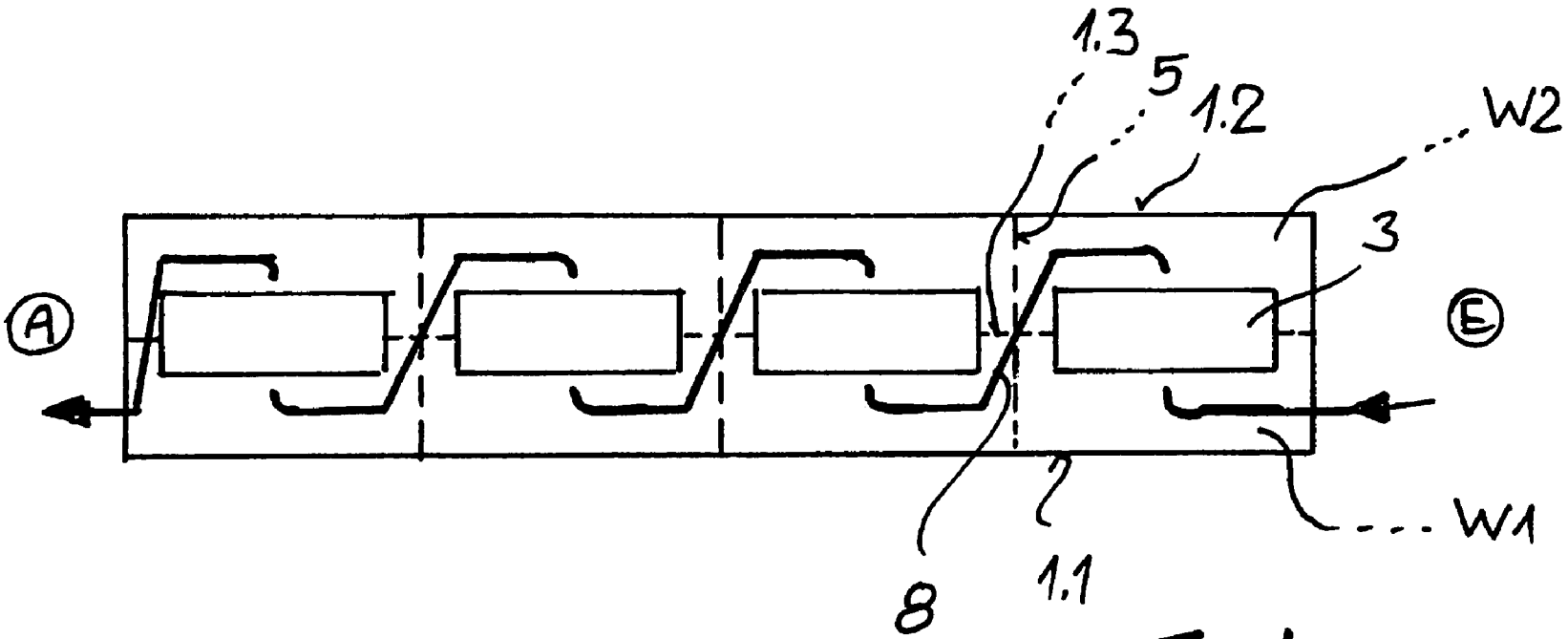
FIG. 4 shows a side view of the cylinder head according to arrow B in FIG. 1.

The return flow path 6.2, which is the upper one as viewed in the direction of the flow, flows through a transfer channel 8 which is substantially arranged in the region of the long side of the cylinder head which forms the supply flow path 6.1 and is conducted in the lower part of the water jacket W1 of the consecutive cylinder head region, as shown in FIG. 4. In this manner the consecutive regions of the cylinders are connected.

Due to this conduction of cooling water a U-shaped flow of the cooling water, which is conducted from the exterior to the interior and vice versa across the longitudinal axis of the row of the cylinders, results in each region of a water jacked separated via a flame deck 1.1, an oil deck 1.2, separations 5 and an intermediate deck 1.3 at each cylinder. Thereby, due to the connection of the drain side of the upper part of the water jacket W2 with the supply side of the consecutive lower part of the water jacket W2 via the overflow channel 8 results in total a screw thread-shaped conduction of flow to the cylinder head including a long distance of cross flow respectively.

Figures 5, 6:
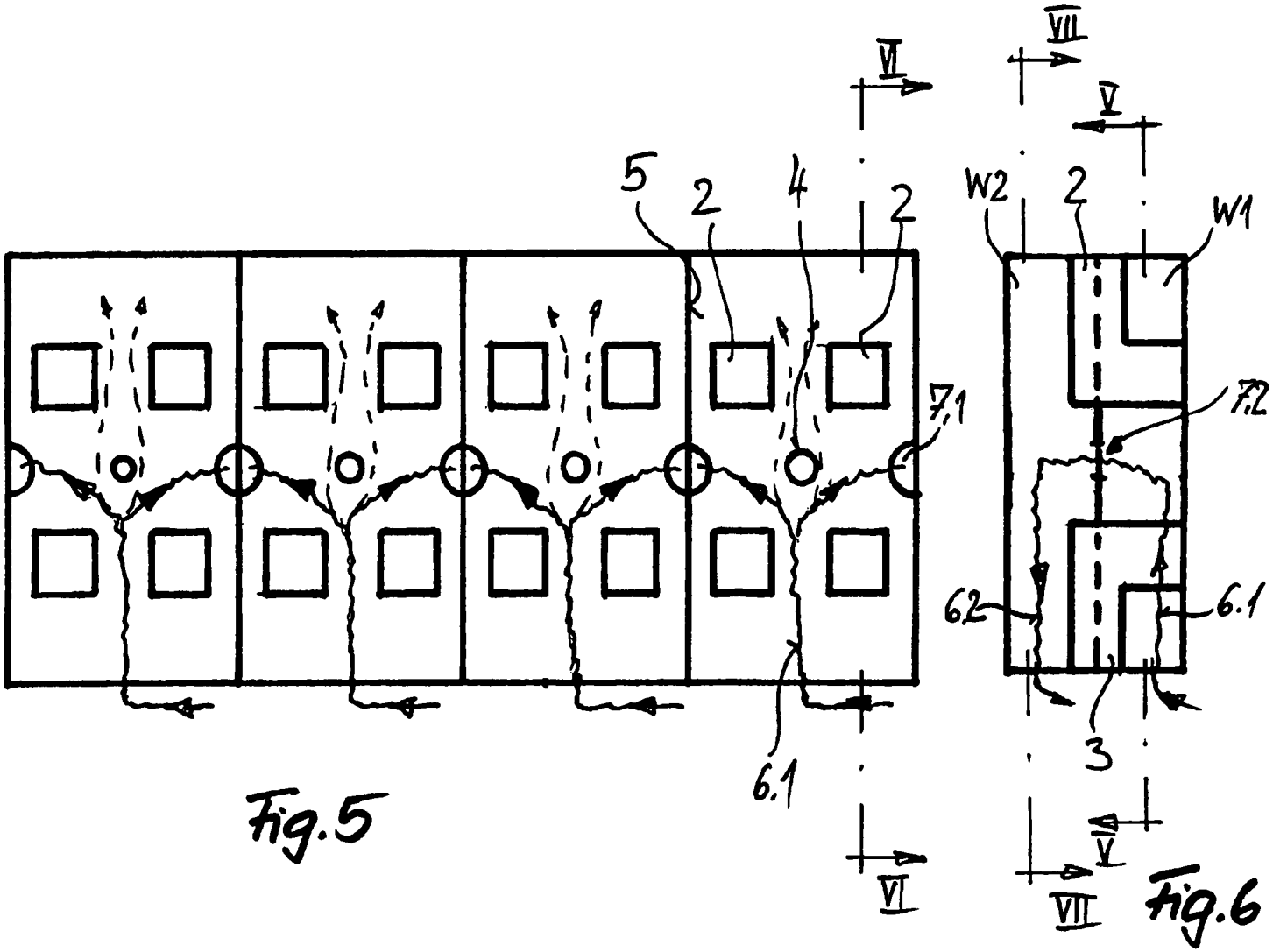
FIG. 5 shows a horizontal section of the lower part of the water jacket along the line V—V in FIG. 6 of a modified embodiment of the cylinder head according to FIG. 1.
FIG. 6 shows a vertical section along the line VI—VI in FIG. 5.
Figure 7:
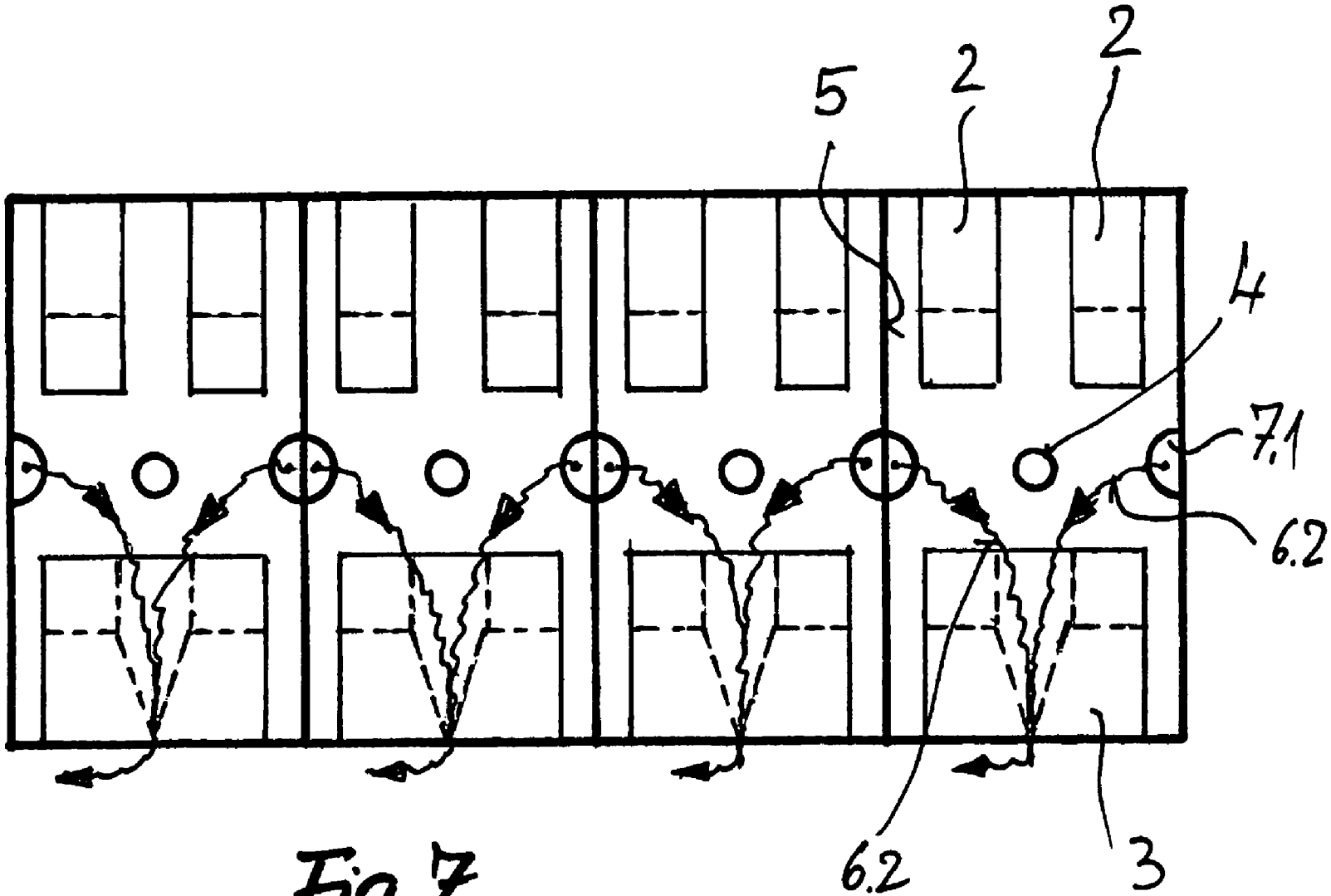
FIG. 7 shows a horizontal section of the upper part of the water jacket along the line VII—VII in FIG. 6.

FIGS. 5, 6 and 7 show a modified embodiment of the cylinder head described in FIGS. 1 to 4, so that reference is made to the preceding description. Similar elements are labelled with the same reference number.

The difference compared to the embodiment according to FIGS. 1 to 4 is that the re-direction of the cooling water flow from the lower part of the water jacket W1 into the upper part of the water jacked W2 is provided with two flow passage openings 7.2, which are arranged each in the direct vicinity of the separations 5 in the intermediate deck 1.3. Favourably these flow passage openings 7.2 are arranged approximately in the region of the longitudinal middle axis L of the reciprocating engine. Hence, the flow passages openings may serve as support of the core of the upper part of the water jacket W2. With a suitable form of the casting of the oil deck 1.2 this core may be fixed against floating.

As in the preceding embodiments according to FIGS. 1 to 4 the supply flow path 6.1 flows towards the receptacle 4, so that the receptacle 4 and the fuel injector received therein are reliably cooled.

As shown in FIG. 5 portions of the flow of the cooling water flows into the region between the two intake ducts 2 due to the direct flow towards the receptacle 4. These portions circulate around said intake ducts 2 to their back side, which is turned away from the receptacle 4, so that the intake ducts are sufficiently cooled in its region directly connected to the flame deck 1.1.

FIG. 7 shows schematically a course of the return flow path 6.2.

As shown in FIG. 4 also in this embodiment the upper part of the water jacket W2 of one cylinder is connected with the lower part of the water jacket of the consecutive cylinder via an overflow channel 8.

Figure 8:
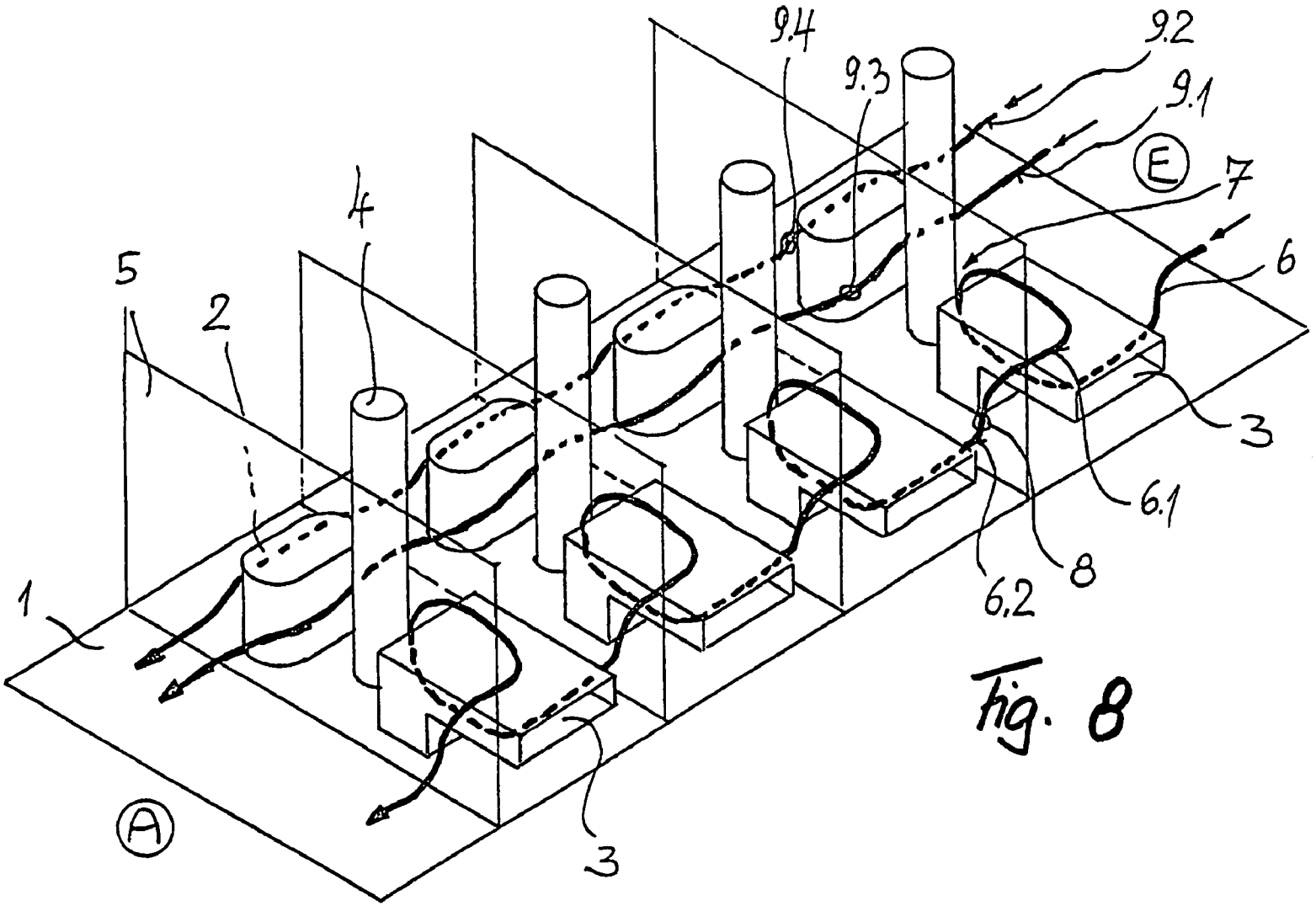
FIG. 8 shows a schematic view of another embodiment of a cylinder head for an elucidation of the water conduction.

FIG. 8 shows the cylinder head of a four-cylinder reciprocating engine with the flame deck 1.1 in a perspective view according to a further embodiment of the invention. For a clear illustration the oil deck of the cylinder head is omitted. Furthermore, an intermediate deck is not provided.

Each cylinder is provided with two intake valves, which are characterized by their common intake connection 2. Furthermore, two exhaust valves per cylinder are provided, which are indicated by their common exhaust duct 3. In each case a receptacle 4 for a fuel injector or for a spark plug is arranged in between the intake duct 2 and the exhaust duct 3.

A transversally aligned separation 5 is arranged in between two adjacent cylinders respectively, separating the intake and exhaust areas of each cylinder from each other. In this case separation 5 is displayed as "transparent". Separation 5 is provided with flow passage openings, which are not shown here in detail, through which the cooling water is conducted from one cylinder area to the other cylinder area.

For the conduction of the cooling water in each cylinder region of the cylinder head, that means in between two separations 5 respectively, channel arrangements or flow channels respectively are provided on the one hand in the region of the exhaust ducts 3 and on the other hand in the region of the intake ducts 2. Said systems of channels or flow channels respectively are for instance casted in the cylinder head.

In the drain-sided area the channel arrangement is conducted in such a manner, that the cooling water is conducted from the supply side E to the drain side A of the cylinder head.

The conduction of the cooling water through the channel arrangement on the gas exhaust side is shown by flow path 6. The flow of the cooling water flows from the exterior below the exhaust duct into the area separated by the two separations 5, further towards the receptacle below the exhaust ducts between the two separated exhausts of the exhaust valves. The space between the two exhausts of the exhaust valves and the receptacle 4 form a reversion region 7, where the cooling water is conducted from below upwards to the top side of the exhaust duct and flows again in direction towards the exterior via the channel arrangement.

The return path 6.2 of the upper region as viewed in direction of the flow is connected to the supply side 6.1 of the consecutive cylinder region via an overflow channel 8 in the separation 5. Due to this conduction of the cooling water a U-shaped flow of the cooling water is generated in each exhaust duct 3 region, which is conducted from the exterior to the interior and vice versa across the longitudinal axis of the row of the cylinders. Thereby, due to the connection of the drain side of the upper part of the water jacket W2 with the supply side of the consecutive lower part of the water jacket W2 via the overflow channel 8 in total a screw thread-shaped conduction of flow to the cylinder head including a long distance of cross flow results, respectively.

For the cooling of the intake ducts 2 adequate flow channels in the cylinder head are provided forming the flow path according to the lines 9.1 and 9.2. Also in this case in the separation 5 adequate flow passages openings are provided, so that in total a longitudinal flow in the region of the intake side of the cylinder head is effected, whereby the intake ducts 2 are circulated around on the side facing the receptacle 4 as well as on the side turned away from the receptacle.

An adjustment of the particular flows of the cooling water may be effected due to a suitable dimensioning of the flow channels and of the flow passage openings in the separations 5, so that in total accordingly different volume flows may be conducted via the intake ducts 2 and the exhaust ducts 3, considering the lower thermal stress of the intake side on the one hand and of the exhaust side on the other hand.

Figure 9:
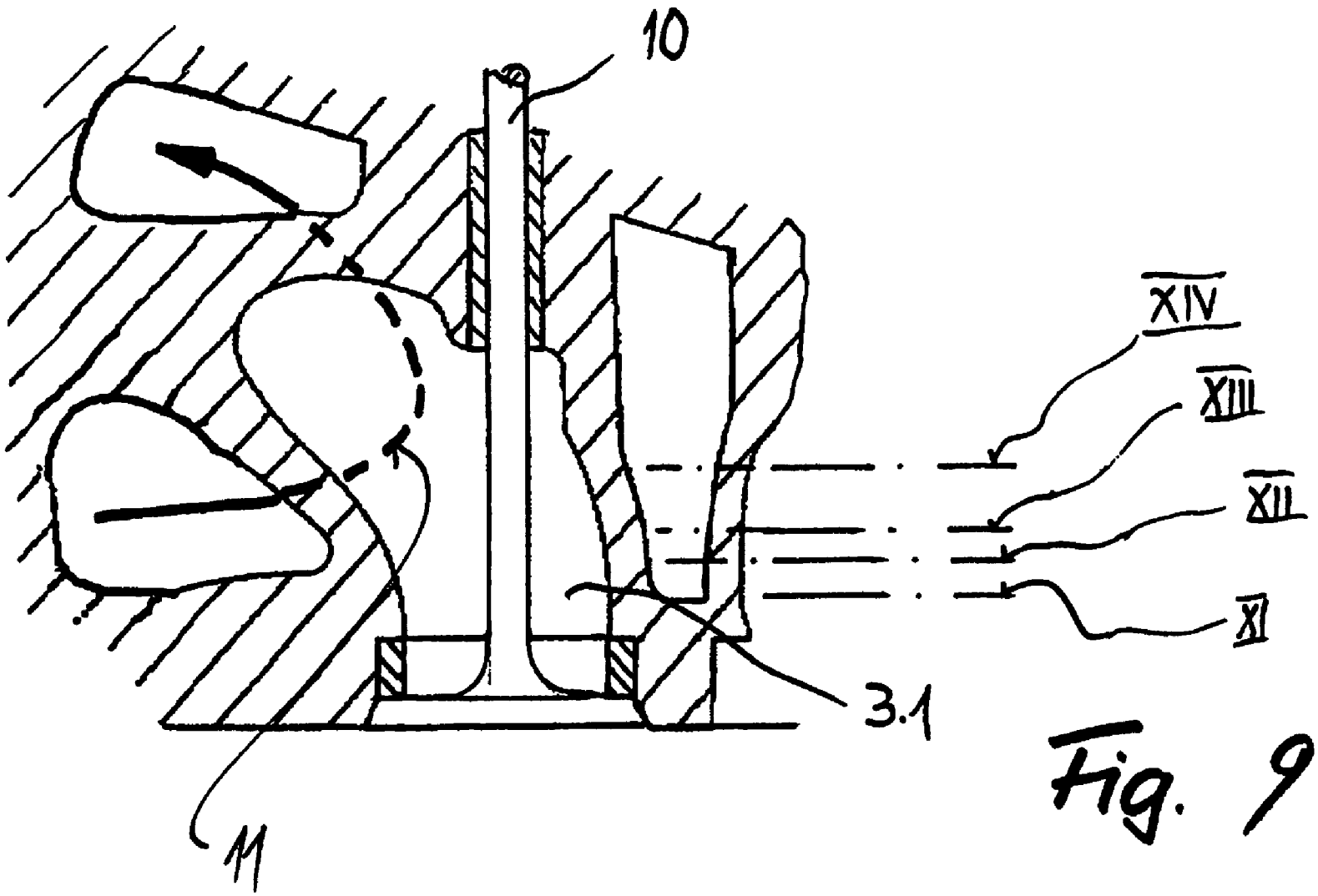
FIG. 9 shows a vertical section of an exhaust valve along the line IX—IX in FIG. 11 across the longitudinal axis of the engine.
Figure 10:
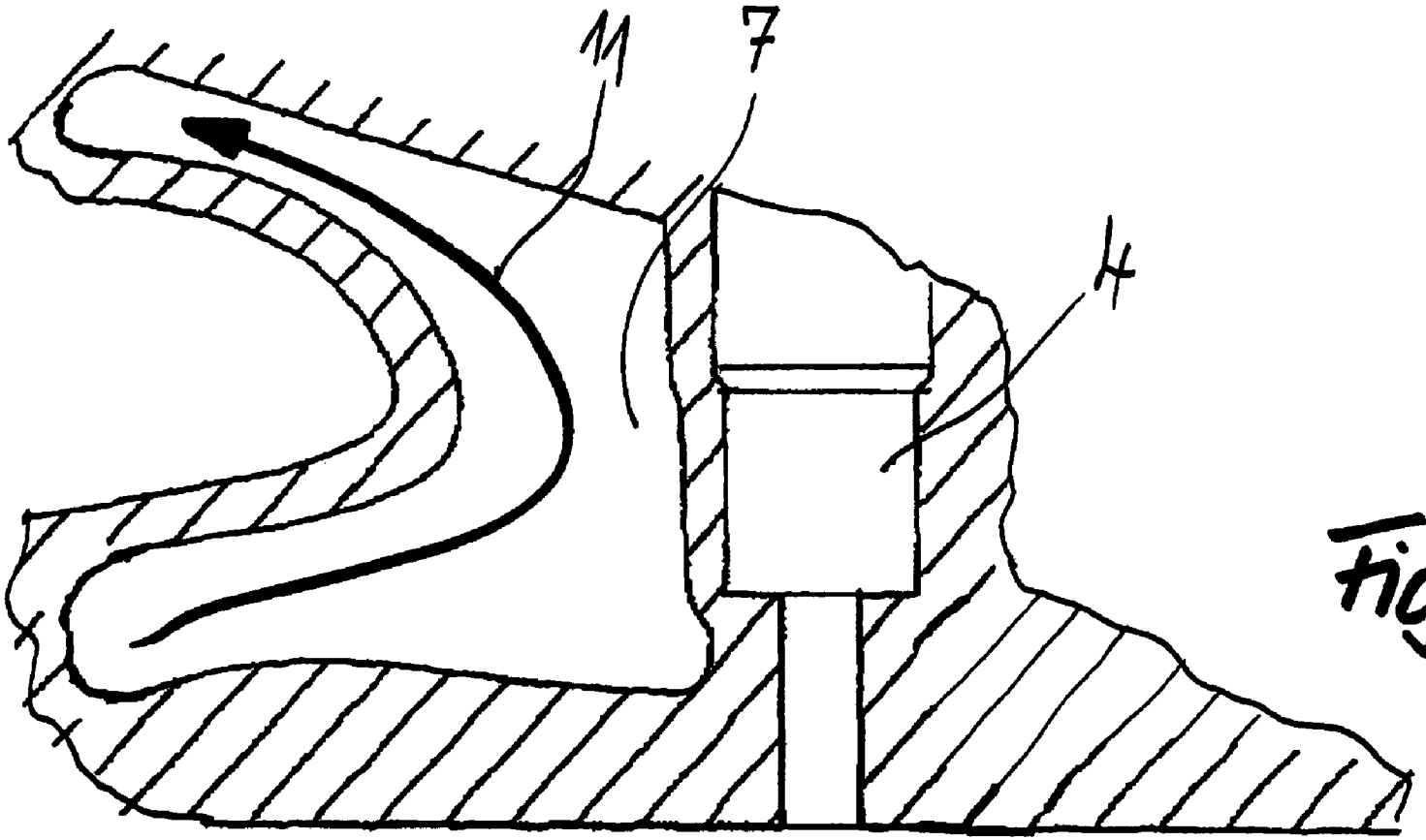
FIG. 10 shows a vertical section of the receptacle along the line X—X in FIG. 11 across the longitudinal engine axis.
Figure 11:
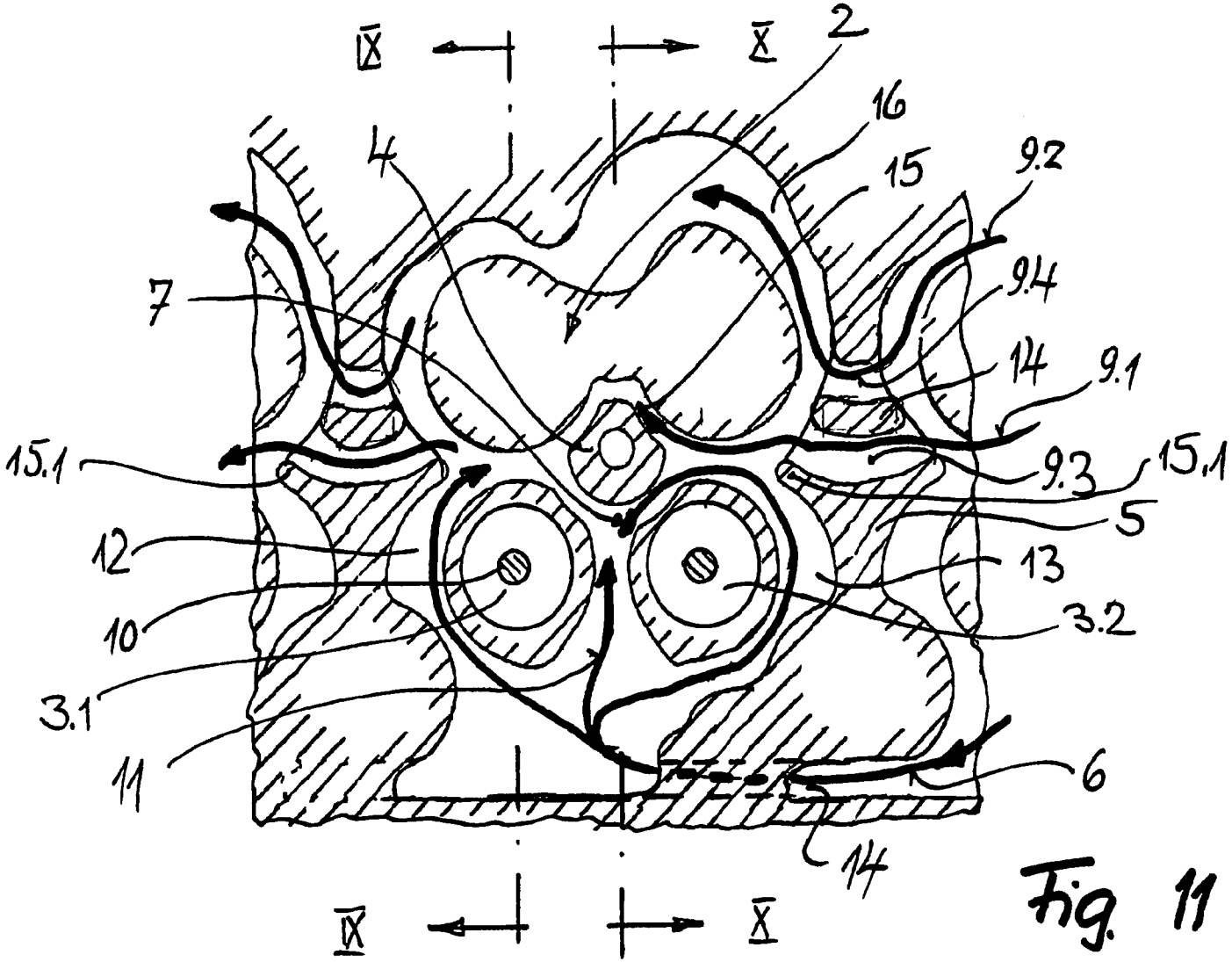
FIG. 11 shows a horizontal section along the line XI—XI in FIG. 9.

FIG. 9 shows a section of a gas exhaust valve transverse to the longitudinal axis, according to line IX—IX in FIG. 11. As shown in FIG. 9, FIG. 10 and FIG. 11, the exhausts 3.1 and 3.2 respectively of a gas exhaust valve 10 are merged to a common exhaust duct 3. Thereby, it is possible that the cooling water may flow between the two exhausts 3.1 and 3.2 into the reversion region 7 in front of the receptacle 4 and that it may flow out of the reversion region 7 above the exhaust ducts 3 again to the exterior as shown in FIG. 1. This is indicated with the arrow 11 of the flow in the FIGS. 2, 3 and 4. As will be seen from the sectional view according to FIG. 4, the channel arrangement comprises branch flow channels 12 and 13 respectively in the region of the exhausts 3.1 and 3.2, so that branch flows around the exhausts 3.1 and 3.2 flow into the reversion region 7.

FIG. 11 shows also the separation 5 with the overflow channel 14 associated therewith, connecting the return flow path 6.2 above the exhaust ducts 3 of the preceding cylinder area with the supply flow path 6.1 of the displayed cylinder area.

Figure 12:
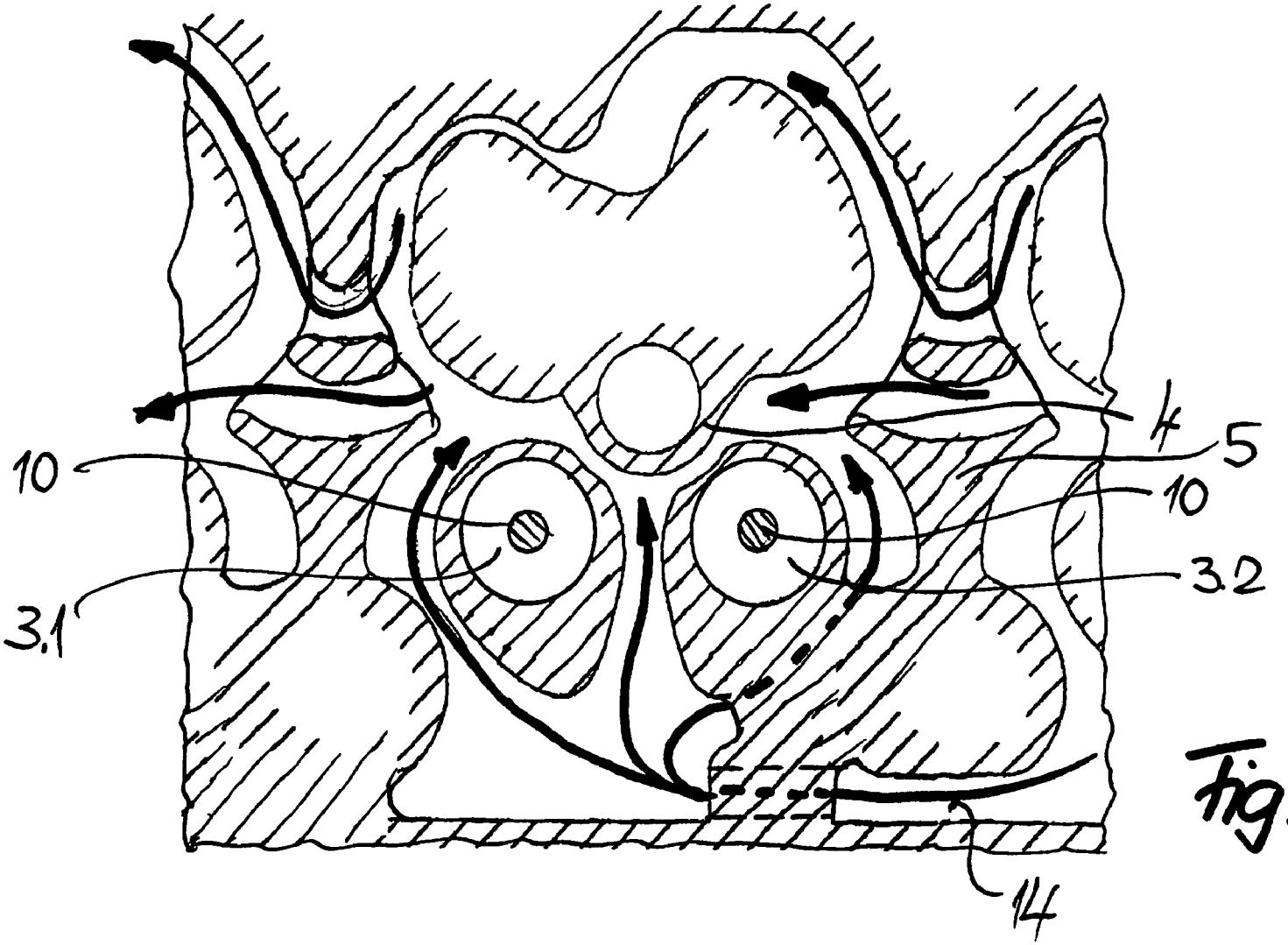
FIG. 12 shows a horizontal section along the line XII—XII in FIG. 9.

As will be further seen from FIGS. 11 and 12 the separation 5 comprises flow passages openings 9.3 and 9.4 associated with the flow paths 9.1 and 9.2 as shown in FIG. 8, which are separated by a flow guiding element 14. A guiding element 15.1 is attached to the flow passage opening 9.2 at least at a drain side. Hereby, the intake duct 2 is provided with an interior flow channel 15 for the flow path 9.1 as well as an exterior flow channel 16 for a flow path 9.2, so that the intake duct 2 as well as the receptacle 4 are circulated around from both sides, respectively. Arrows of the flow indicate the course of the flow.

Figure 13:
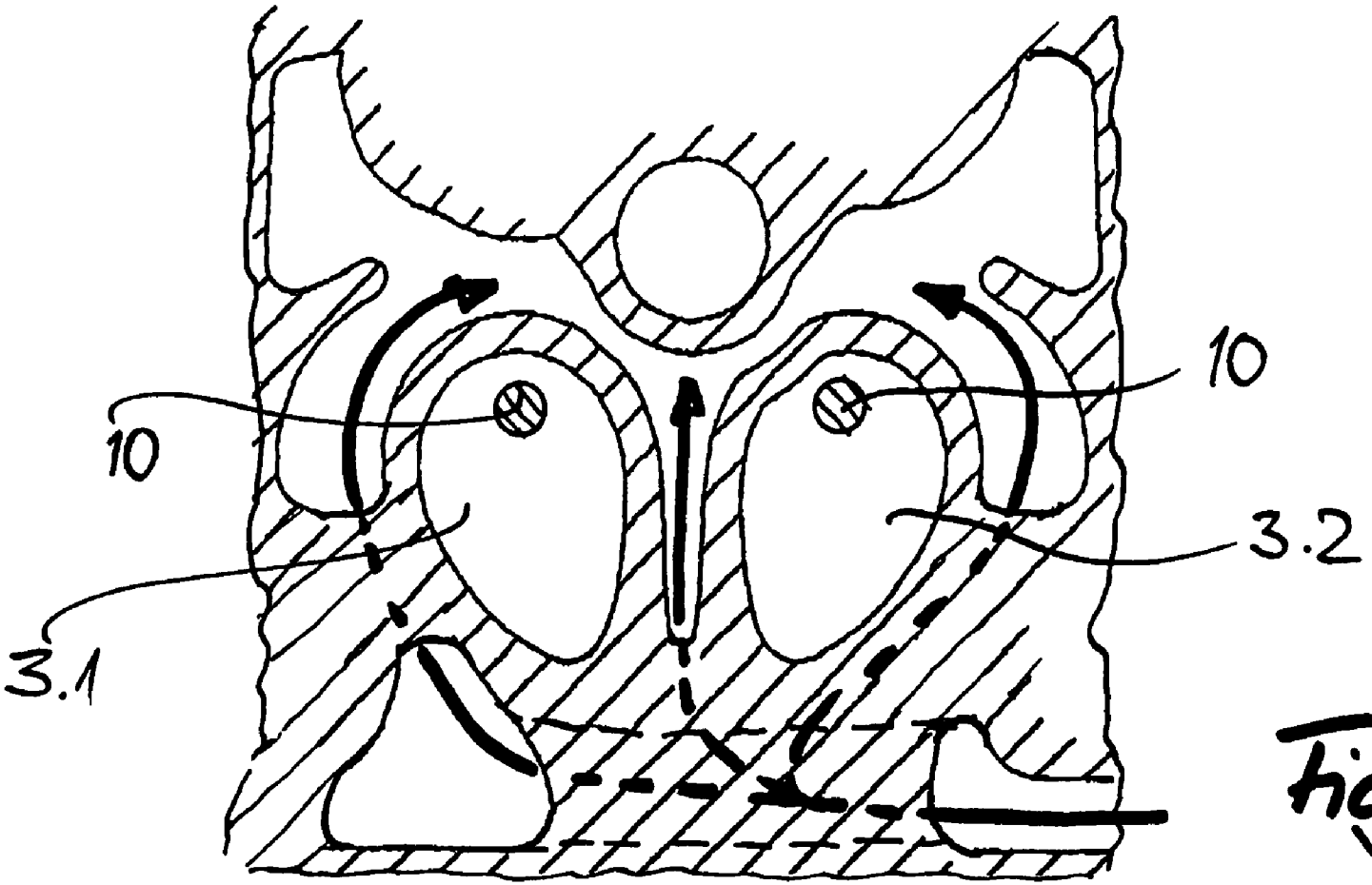
FIG. 13 shows a horizontal section along the line XIII—XIII in FIG. 9.
Figure 14:
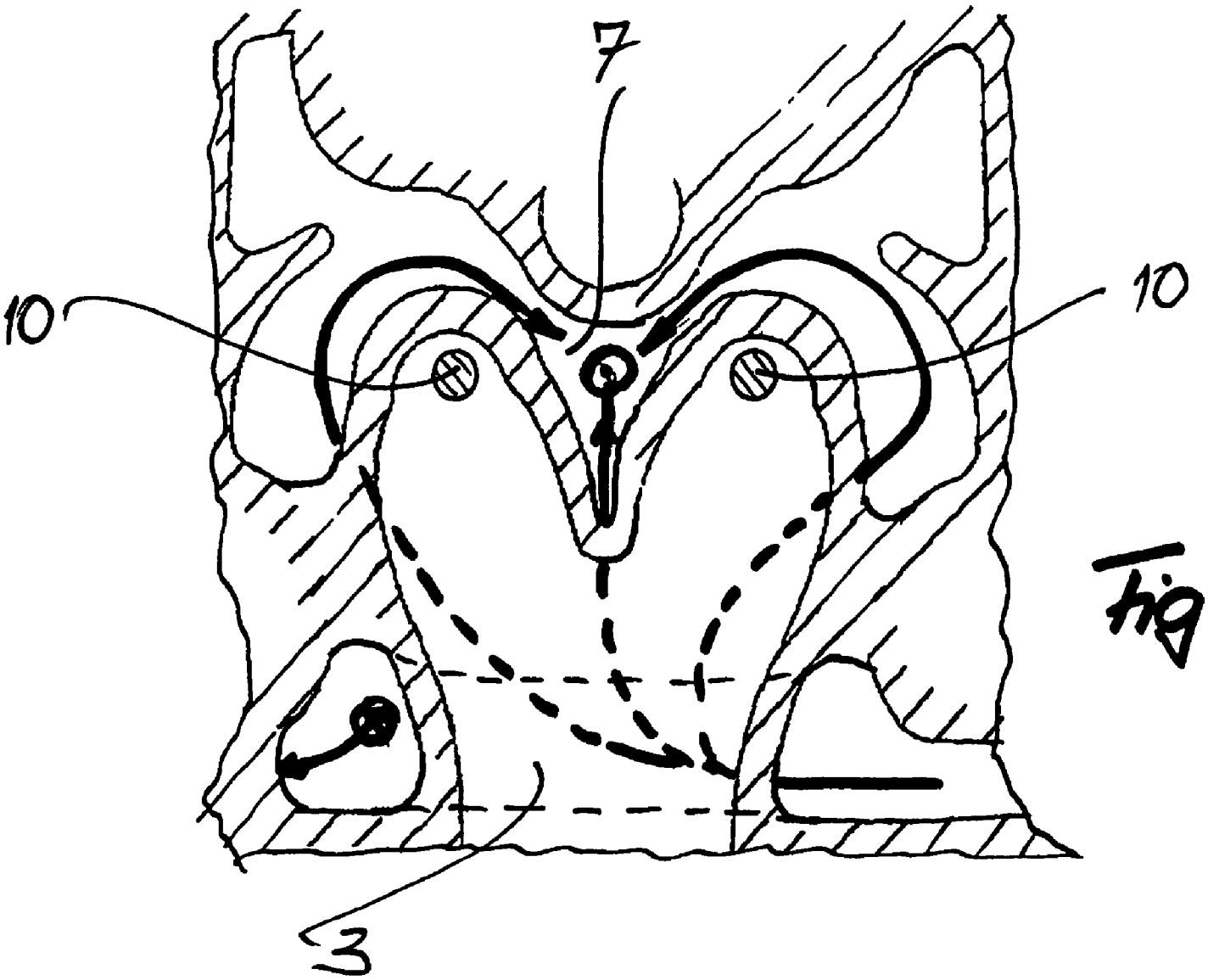
FIG. 14 shows a horizontal section along the line XIV—XIV in FIG. 9.

The sectional views according to FIGS. 12, 13, and 14 show the course of the flow in the different sectional plains, whereas in FIGS. 13 and 14 only the region of the exhaust ducts is shown.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. Cylinder head comprising a water jacket limited by a flame deck and an oil deck at a water cooled reciprocating engine with cylinders that are arranged in series, each of said cylinders comprises at least one intake valve with an intake duct and two exhaust valves, which exhausts open into an exhaust duct, with a receptacle for a fuel injector or a spark plug, that is located between the intake valve and the exhaust valves, characterized in that for conducting a coolant in the water jacket an arrangement of channels is provided at least in the region of an exhaust side of each cylinder, through which in an inflow the coolant supply is conducted from an exterior on one side of the exhaust duct inwards towards the receptacle and is conducted from an interior in a reflux to the exterior on the other side of the exhaust duct and in that an overflow channel is provided, conducting a return flow path, as viewed with respect to the direction of flow, to a channel arrangement which forms a supply flow path of a channel arrangement of the consecutive cylinder head region.

2. Cylinder head according to claim 1, characterized in that a space between the exhausts of the exhaust valves and the receptacle forms a reversion region for the flow.

3. Cylinder head according to claim 1, characterized in that a supply-sided part of the channel arrangement each runs below the exhaust duct and in that the return-sided part of the channel arrangement each runs above the exhaust duct.

4. Cylinder head according to claim 1, characterized in that a separation is provided between intermediate regions related to adjacent cylinders in order to conduct the cooling water.

5. Cylinder head according to claim 1, characterized in that the water jacket that is limited by the flame deck and the oil deck is separated by an intermediate deck into an upper part of the water jacket and a lower part of the water jacket.

6. Cylinder head according to claim 1, characterized in that one part of parts of the water jacket, preferably a lower part, is connected on a supply side to an overflow channel and in that an other part of the water jacket is connected on a drain side to a part of the water jacket of an adjacent cylinder region via the overflow channel, respectively.

7. Cylinder head according to claim 1, characterized in that an intermediate deck comprises at least one flow passage opening connecting a lower part of the water jacket with an upper part of the water jacket forming a reversion region.

8. Cylinder head according to claim 1, characterized in that a flow passage opening is located in the region of the intake duct in each case.

9. Cylinder head according to claim 1, characterized in that at separations facing each other at least one flow passage opening is arranged connecting a lower part of the water jacket with an upper part of the water jacket.

10. Cylinder head according to claim 9, characterized in that the flow passage openings are each arranged at opposing separations in the region of a longitudinal center axis.

11. Cylinder head according to claim 1, characterized in that a supply-sided part of the channel arrangement comprises a main channel running between exhaust ducts of the exhaust valves and each a branch channel, which is lead around each exhaust ducts and which runs into the reversion region.

12. Cylinder head according to claim 1, characterized in that the intake duct is enfolded by flow channels at least at a side that opposes the exhaust ducts.

13. Cylinder head according to claim 1, characterized in that the separation comprises at least one overflow channel connecting the channel arrangements of adjacent cylinders.

14. Cylinder head according to claim 1, characterized in that flow channels each comprising the intake ducts of adjacent cylinders are interconnected via flow passages openings located in the separation.

15. Cylinder head according to claim 1, characterized in that flow passage openings of flow channels assigned to the intake duct are formed by at least one guiding element in the separation for a redirection of the cooling water into juxtaposed flow channels.

* * * * *